US006543093B2

(12) United States Patent
Hösel et al.

(10) Patent No.: US 6,543,093 B2
(45) Date of Patent: Apr. 8, 2003

(54) APPARATUS FOR DETECTING DISPLACEMENTS AND/OR PRESENCE OF SLIVER IN A FIBER PROCESSING MACHINE

(75) Inventors: Fritz Hösel, Mönchengladbach (DE); Gunter Duda, Mönchengladbach (DE); Franz-Josef Minter, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 09/883,993

(22) Filed: Jun. 20, 2001

(65) Prior Publication Data

US 2001/0034925 A1 Nov. 1, 2001

Related U.S. Application Data

(63) Continuation of application No. 09/769,282, filed on Jan. 26, 2001, now abandoned.

(30) Foreign Application Priority Data

Jan. 28, 2000 (DE) ..... 100 03 861

(51) Int. Cl.[7] ..... D01H 5/32
(52) U.S. Cl. ..... 19/239; 19/0.2; 19/236
(58) Field of Search ..... 19/239, 236, 0.2, 19/157, 0.25, 150, 0.21, 0.22, 0.23, 0.24, 0.26, 159 A, 159 R; 57/80, 81, 83, 86, 264, 265; 226/11, 24, 45; 242/157 R, 615.3

(56) References Cited

U.S. PATENT DOCUMENTS

| | | | | |
|---|---|---|---|---|
| 3,114,233 A | | 12/1963 | Guri | |
| 3,287,887 A | | 11/1966 | Dornberger | |
| 3,309,859 A | | 3/1967 | Vehorn | |
| 3,621,267 A | | 11/1971 | Dent | |
| 4,160,360 A | | 7/1979 | Carvalho et al. | |
| 4,888,944 A | | 12/1989 | Felix | |
| 4,914,785 A | * | 4/1990 | Hauner et al. | 19/0.25 |
| 4,982,477 A | * | 1/1991 | Hosel | 19/0.25 |
| 5,487,208 A | * | 1/1996 | Hauner | 19/157 |
| 6,081,972 A | * | 7/2000 | Strobel et al. | 19/0.25 |

FOREIGN PATENT DOCUMENTS

| | | |
|---|---|---|
| AT | 264329 | 8/1968 |
| DE | 1 112 432 | 8/1961 |
| DE | 2 059 418 | 6/1971 |
| DE | 24 50 207 | 4/1976 |
| DE | 26 21 900 | 1/1977 |
| DE | 27 00 287 | 7/1977 |
| DE | 29 53 108 | 12/1980 |
| DE | 30 35 754 | 4/1981 |
| DE | 35 37 195 | 4/1987 |
| DE | 36 32 911 | 4/1987 |
| DE | 38 30 665 | 3/1990 |

(List continued on next page.)

*Primary Examiner*—Gary L. Welch
(74) *Attorney, Agent, or Firm*—Gabor J. Kelemen; Robert Kinberg; Venable, LLP

(57) ABSTRACT

A fiber processing machine includes an arrangement for forwarding a sliver through a space in an advancing direction; an arrangement for continuously displacing the sliver in the space transversely to the advancing direction while the sliver is forwarded in the advancing direction; and an apparatus for detecting a presence, absence, motion or standstill of a sliver. The apparatus includes a transmitter emitting a sensor beam passing through the space transversely to advancing direction for being intermittently interrupted by the sliver during displacement thereof transversely to the advancing direction; and a receiver positioned in a path of the sensor beam for receiving a light or a dark signal dependent whether or not the sensor beam is interrupted by the sliver during displacement thereof transversely to the advancing direction.

19 Claims, 11 Drawing Sheets

FOREIGN PATENT DOCUMENTS

| | | |
|---|---|---|
| DE | 38 31 637 | 4/1990 |
| DE | 40 28 365 | 3/1992 |
| EP | 0 418 780 | 3/1991 |
| EP | 0 451 328 | 10/1991 |
| EP | 0 480 898 | 4/1992 |
| EP | 0 679 599 | 11/1995 |
| GB | 1 539 570 | 1/1979 |
| JP | 55045833 | 3/1980 |

* cited by examiner

APPARATUS FOR DETECTING DISPLACEMENTS AND/OR PRESENCE OF SLIVER IN A FIBER PROCESSING MACHINE

CROSS REFERENCE TO RELATED APPLICATION

This application is a continuation of application Ser. No. 09/769,282 filed Jan. 26, 2001 now abandoned.

This application claims the priority of German Application No. 100 03 861.1 filed Jan. 28, 2000, which is incorporated herein by reference.

BACKGROUND OF THE INVENTION

This invention relates to an apparatus for detecting whether a cotton or chemical fiber sliver in a fiber processing machine, particularly a draw frame, is advanced or is stationary and/or whether it is present or absent. The sliver passes through a space accommodating at least one sensor device composed of a transmitter and a receiver. The direction of sensor rays (such as light rays) is essentially perpendicular to the advancing direction of the sliver.

In a known device as disclosed in German Offenlegungsschrift (application published without examination) No. 38 34 110, to which corresponds U.S. Pat. No. 4,982,477, the thickness of the sliver is consecutively measured by a sensor device and, by comparing the data with at least one previous measurement, it is determined whether changes in the thickness occur as a function of time. A difference in the thickness measured indicates that the sliver moves. It is a disadvantage of such an arrangement that the sensor device is structurally expensive. In particular, the receiving device for detecting the sliver thickness (shadow effect) is complex.

SUMMARY OF THE INVENTION

It is an object of the invention to provide an improved apparatus of the above-outlined type from which the discussed disadvantages are eliminated and which, in particular, is structurally simple and economical.

This object and others to become apparent as the specification progresses, are accomplished by the invention, according to which, briefly stated, a fiber processing machine includes an arrangement for forwarding a sliver through a space in an advancing direction; an arrangement for continuously displacing the sliver in the space transversely to the advancing direction while the sliver is forwarded in the advancing direction; and an apparatus for detecting a presence, absence, motion or standstill of a sliver. The apparatus according to the invention includes a transmitter emitting a sensor beam passing through the space transversely to advancing direction for being intermittently interrupted by the sliver during displacement thereof transversely to the advancing direction; and a receiver positioned in a path of the sensor beam for receiving a light or a dark signal dependent whether or not the sensor beam is interrupted by the sliver during displacement thereof transversely to the advancing direction.

A sliver motion in the advancing direction may be detected in a simple manner by virtue of the fact that the sliver is movable along a path lying in a plane which is essentially perpendicular to the advancing direction. When the sliver periodically intersects (interrupts) the sensor rays, it is an indication that the sliver moves in the advancing direction. When the rays are continuously either interrupted or not interrupted, it is an indication that the sliver is either stationary or no sliver is present (that is, a sliver rupture has occurred). It is a particular advantage of such an arrangement that the transmitter and the receiver—in contrast to the known device—need not measure the thickness of the sliver; rather, a detection of interruption or non-interruption of the rays suffices, resulting in an overall economical device.

The invention has the following additional advantageous features:

- The path of the sliver may be circular or oval.
- The space where measurement takes place is the inner space of a sliver guide.
- The optical or electro-optical transmitter and receiver elements are integrated in the sliver guide.
- The inner space of the sliver guide has a circular outline.
- The sliver guide is situated at the creel of a draw frame, between a coiler can and a deflecting roll (supply roll) mounted on the creel.
- The transmitter and the receiver are situated in the sliver guide and a transmitter part and a receiver part are flush with the inner wall defining the inner space of the sliver guide.
- Between the transmitter and the receiver a ray-deflecting mirror (reflector) is provided.
- The transmitter and the receiver are connected to an electronic microcomputer control-and-regulating device (computer) and the signals produced by the receiver are processed by an electronic evaluating device.
- The fiber processing machine simultaneously handles a plurality of slivers, each passing through its own sliver guide and with each sliver guide a separate sensor apparatus is associated.

The invention further encompasses an apparatus for detecting textile fibers in fiber processing machines, particularly draw frames, where, one or more electrooptical transmitters, receivers and/or reflector (mirror) combinations are provided for each sliver to be sensed. Each such combination is preferably integrated into a respective sliver guide. The signals of the receivers are centrally processed by an evaluating unit which is connected to the usual machine control system, and, for an optimal detection, obtains information on the condition of the fiber processing machine and transfers information on all the incoming slivers to the machine control system. A substantial economic advantage is obtained by virtue of the fact that for a plurality of detecting units a central evaluating unit is provided which is connected with the usual machine control. In addition, for a better and more secure detection, the evaluating unit may utilize information on the momentary operating parameters of the draw frame such as output speed.

The invention has the following additional advantageous features:

- The presence of slivers and/or their displacement during processing is monitored.
- The detection system operates in a "self-learning" mode in which the signal pattern used for comparison during a learning phase or during certain occurrences is saved. Since the sliver in practice often does not move on an ideal circular path and the shape of the actual displacement depends, among others, from the material used, the output rate as well as the sliver thickness, the material-specific and production-specific behavior of the sliver may be detected once or continuously by self-learning. Thereafter the results may be repeatedly compared with the production in progress and in case of significant deviations, a suitable response (for example, braking) is triggered. Thus, in this manner material-specific and production-specific signal patterns of the receiver may be generated and stored and may be called later if needed for comparison. Such a function is particularly advantageous for a plurality of sensor units when a central evaluating unit is used.

The detected signal patterns are automatically or manually adjusted as a function of production conditions. Given such a possibility, the detected signal pattern may be adjusted, for example, as a function of changes in the production speed and to thus again obtain an operationally reliable detection.

The utilized signal patterns are adjusted or corrected as a function of certain production parameters of the fiber processing machine.

The electrooptical transmitter and receiver elements are not situated in the detection unit but at another location, preferably on the evaluating unit and transfer the optical information by means of optical wave guides from the detection unit to the transmitter and receiver elements. This provides for a further advantageous possibility to economically build the detection units having a small spatial requirement.

The motion of the sliver is detected by comparing the generated signal pattern emitted by the receiver with a previously inputted pattern.

The evaluation of the receiver signals is carried out while taking certain production parameters into consideration.

The fiber processing machine is controlled as a function of the evaluated signals.

The evaluating unit transfers separate signals for "sliver is present" and "sliver is in motion" to the machine control system.

The evaluating unit transfers in each instance a joint signal to the machine control for all the receivers. By virtue of the fact that the evaluating unit delivers a joint signal for all connected detecting units to the machine control, an advantageous embodiment of the evaluating device is obtained.

The braking of the fiber processing machine occurs when a sliver is missing or is stationary, dependent on the position of the sliver. Since such a braking has to occur very rapidly (substantial deceleration), the moving components (for example, drive belts of the machine) are highly stressed. It is therefore desired that such a braking not be more forceful than absolutely necessary to thus only ensure that the remainder of a broken sliver does not enter into the measuring intake trumpet. Thus, since the intake locations of the slivers may be several meters apart, in case of a failure of an incoming sliver which enters the machine at a substantial distance from the measuring intake trumpet, the machine may be braked less forcefully and thus the material is more gently handled than in case of a sliver which enters very close to the trumpet.

Expediently, plausibility checks are being carried out. The evaluating unit, apart from determining "sliver present/not present" and "sliver moves/doesn't move", may transmit further information to the engine control system, for example, for the purpose of plausibility checks.

DESCRIPTION OF THE PREFERRED EMBODIMENTS

Figure 1:
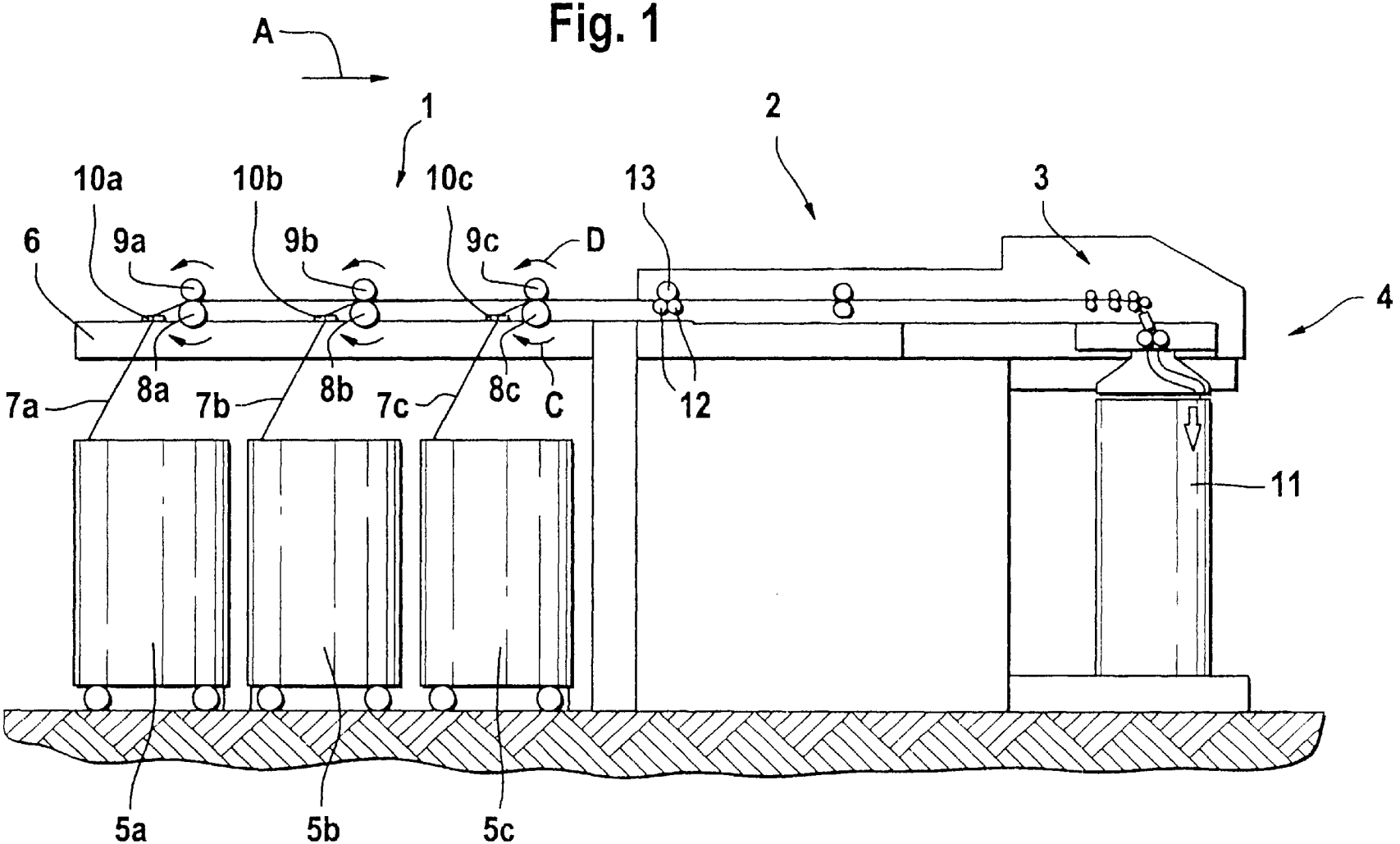
FIG. 1 is schematic side elevational view of a draw frame and a creel, incorporating the invention.

FIG. 1 shows the inlet region 1, the measuring region 2, a draw unit 3 and a sliver coiler system 4 of a draw frame which may be an HSR Model, manufactured by Trützschler GmbH & Co. KG, Mönchengladbach, Germany. In the inlet region 1 three round coiler cans 5*a*, 5*b* and 5*c* are visible which are positioned underneath a creel 6. The slivers 7*a*, 7*b* and 7*c* are withdrawn from the respective coiler cans over supply rolls 8*a*, 8*b* and 8*c* and are advanced to the draw unit 3. With each driven supply roll 8*a*, 8*b* and 8*c*, a respective upper roll 9*a*, 9*b* and 9*c* is associated and is driven by friction from the lower, supply roll. The slivers 7*a*–7*c* are crushed between the respective roll pairs. After passing through the draw unit 3, the drawn sliver is introduced into a coiler disk of a sliver coiling device and is deposited in loops into an output coiler can 11.

In the region of each lower roll (supply roll) 8*a*–8*c* a respective guiding device 10*a*–10*c* is provided for guiding the respective slivers 7*a*–7*c*.

The running direction of the slivers from the supply rolls in the direction of the draw unit is designated at A.

Figure 3:
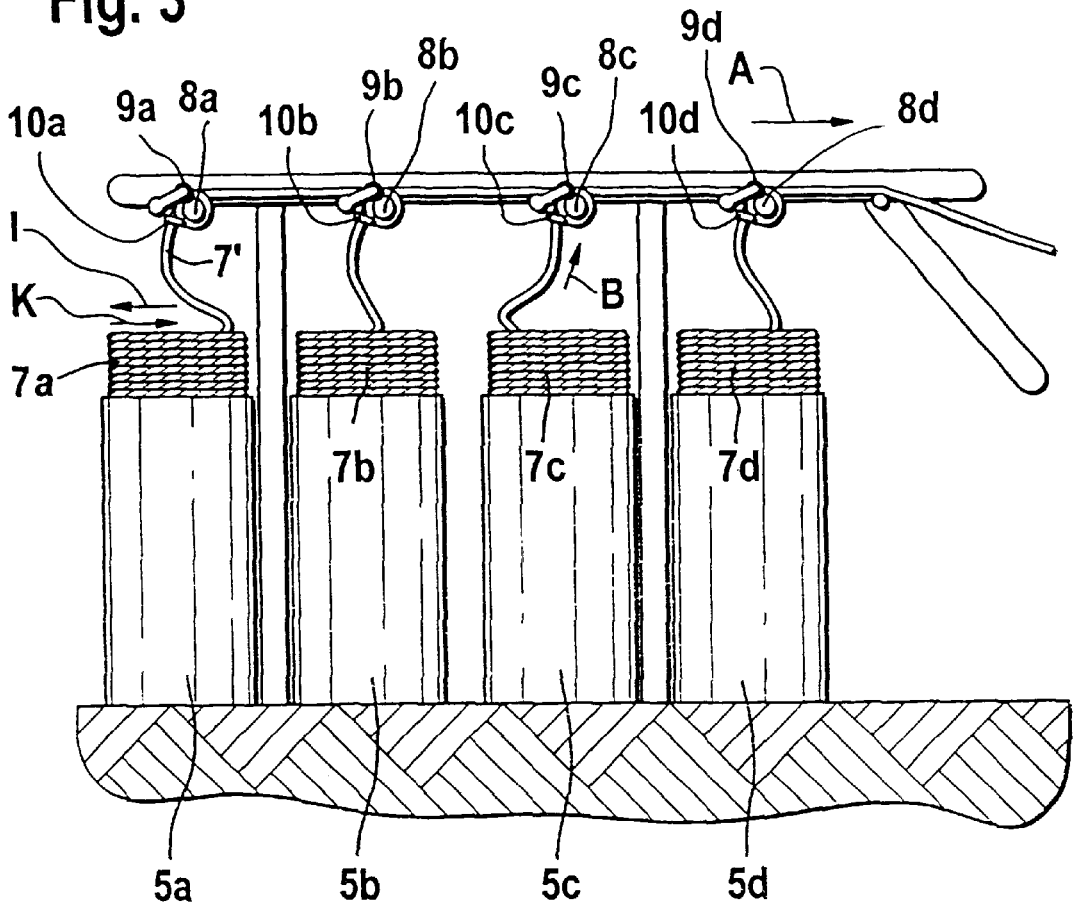
FIG. 3 is a schematic side elevational view of the creel illustrating the ballooned course of the slivers as they are removed from the coiler cans.

Also referring to FIG. 3, as the slivers 7*a*–7*c* are pulled from the respective coiler cans 5*a*–5*c*, they balloon and swing above the coiler cans 5, particularly when they advance at high speed and become quieted after passing the respective supply rolls 8*a*–8*c*. The direction of rotation of the supply rolls 8*a*–8*c* and the upper rolls 9*a*–9*c* is indicated by the respective curved arrows C, D in FIG. 1.

Downstream of the creel 6 as viewed in the direction of sliver advance, that is, at the inlet of the draw frame, a driven roll assembly is arranged which is composed, for example, for each sliver, of two lower rider rolls 12 and an upper rider roll 13.

Figure 2:
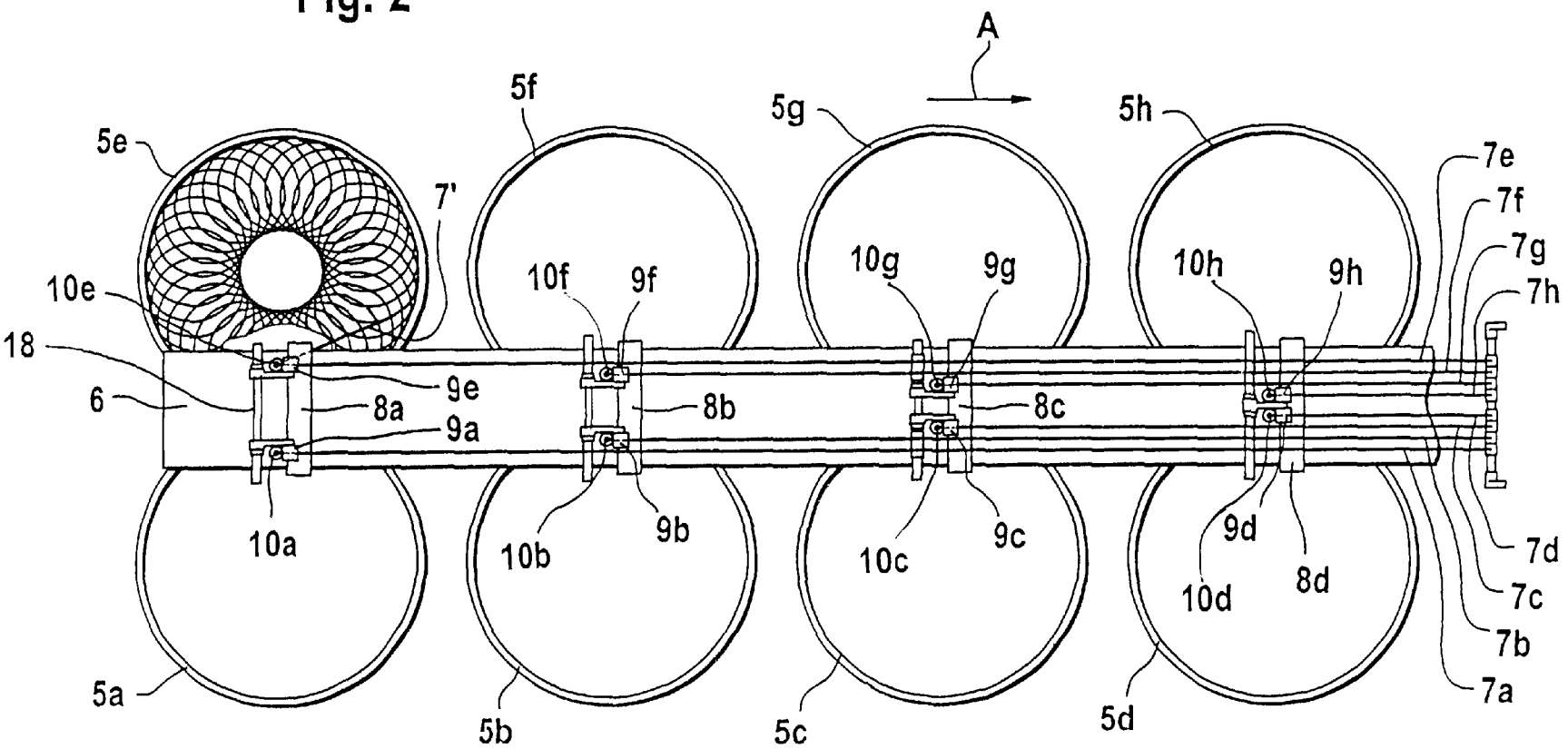
FIG. 2 is an enlarged top plan view of the creel shown in FIG. 1.

Turning to FIG. 2, on each side of the creel 6 a row of coiler cans 5*a*–5*d* and, respectively, 5*e*–5*h* are provided in a parallel arrangement. In operation, it is feasible to pull a respective sliver 7' simultaneously from all eight coiler cans. As an alternative, however, simultaneously only coiler cans on one side, for example, the four coiler cans 5*a*–5*d*, supply a respective sliver 7' whereas on the other side the four coiler cans 5*e*–5*h* are being replaced. FIG. 2 shows an embodiment with four supply rolls 8*a*–8*d* and eight upper rolls 9*a*–9*h*. As seen, each supply roll is provided with two upper rolls serving sliver from the one and the other coiler can row. The supply rolls may have the same diameter, for example, 100 mm, and they may be driven such that their rpm, and thus their circumferential speed decrease in the working direction A. By setting the rpm of the supply rolls individually, the intake tension of all slivers 7*a*–7*h* may be individually adjusted. The supply rolls may be driven by individual motors, or by a single motor via gearing or step-down devices. As seen in the top plan view of FIG. 2, the slivers 7*a*–7*h* run from respective sliver guides 10*a*–10*h* (each including a measuring unit) essentially linearly and parallel to one another. Such a sliver orientation may be maintained up to the end of the draw unit 3.

Figure 2A:
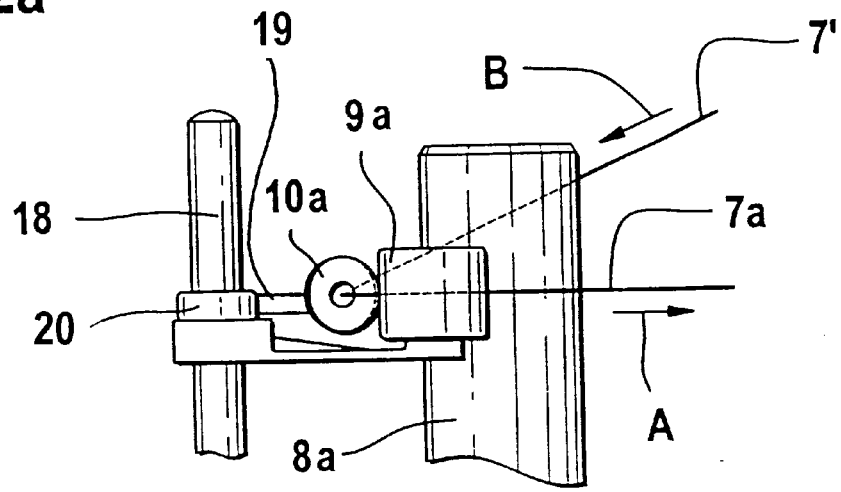
FIG. 2*a* is an enlarged top plan view of a detail of FIG. 2.
Figure 2B:
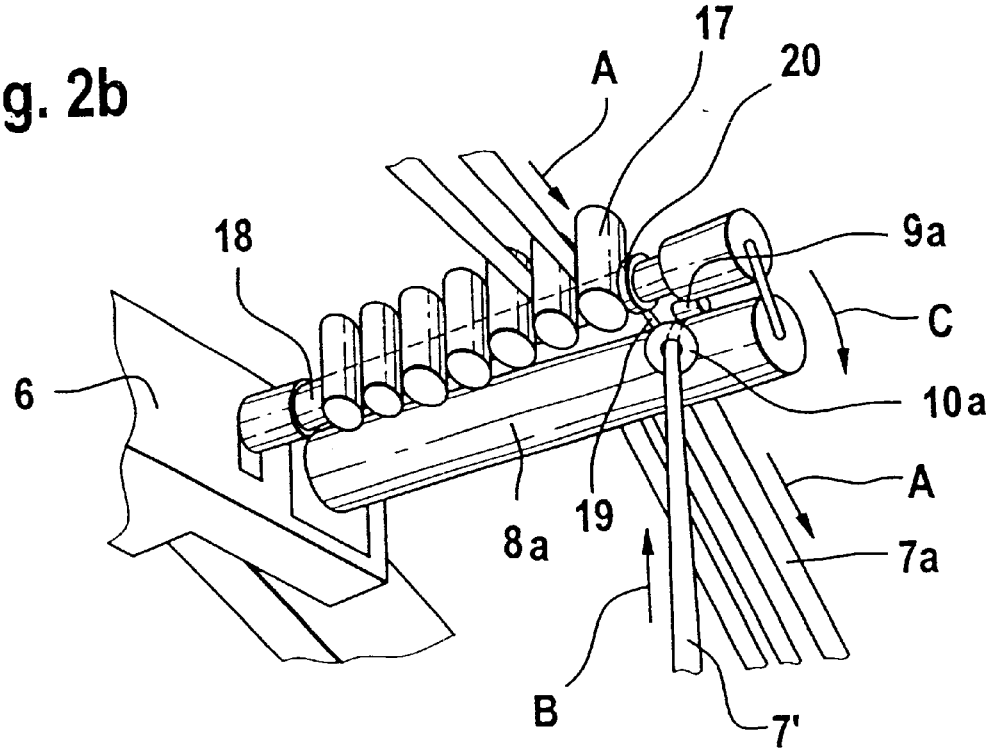
FIG. 2*b* is a perspective view illustrating sliver guides of the creel.

As shown in FIG. 2*a*, the sliver 7*a* pulled from the coiler can 5*a*, first rises from the coiler can 5*a* as a sliver portion 7' and then passes through the opening (eyelet) of the sliver guide 10*a* and, while doing so, is deflected in the direction A and subsequently enters through the nip between the driven supply roll 8*a* and the co-rotating upper roll 9*a*. According to FIG. 2*b*, the slivers 7 are passed through the upwardly open guide grooves between guide organs 17. The sliver guide 10*a* is, by means of a holding bar 19 and a securing ring 20, attached to a stationary holding bar 18 which, in turn, is mounted on the creel 6. As shown in the top plan view of FIG. 2, the sliver 7 is deposited in loops in the coiler can 5*e* such that the loops do not reach the can center. This is frequently the case when large coiler cans (moved from the non-illustrated carding machine) are used.

Figure 3A:
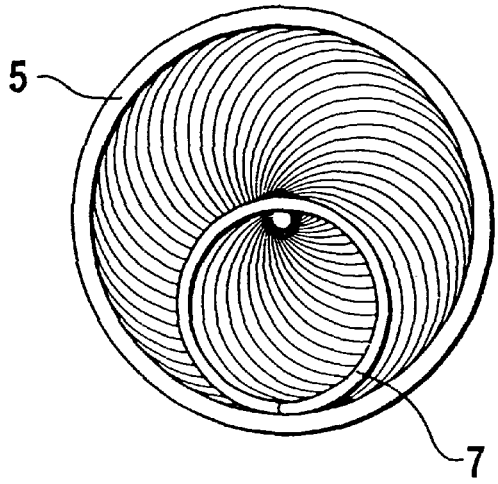
FIG. 3*a* is a top plan view illustrating a loop-pattern of the sliver deposited in a coiler can.

Turning to FIG. 3, the sliver guides 10*a*–10*d* are arranged between the coiler cans 5*a*–5*d*, on the one hand, and the respective roll pairs 8*a*, 9*a* through 8*d*, 9*d*, on the other hand. As the slivers 7*a*–7*d* are removed from the uppermost sliver coil in the respective coiler cans 5*a*–5*d*, the sliver portion 7' situated between the coiler can and the respective roll pair (for example, the roll pair 8*a*,9*a*) advances upward in the direction of the arrow B and assumes a ballooning configuration which rotates about a virtual longitudinal axis and is essentially perpendicular to the advancing direction B, as indicated by the arrows I, K. The top plan view of FIG. 3*a* shows that the sliver 7 is deposited in loops in the coiler can 5. It is seen that the loop diameters are large and thus the loops extend beyond the central axis of the coiler can which is frequently the case when small coiler cans 5 (moved from a non-illustrated carding machine) are used.

Figure 4A:
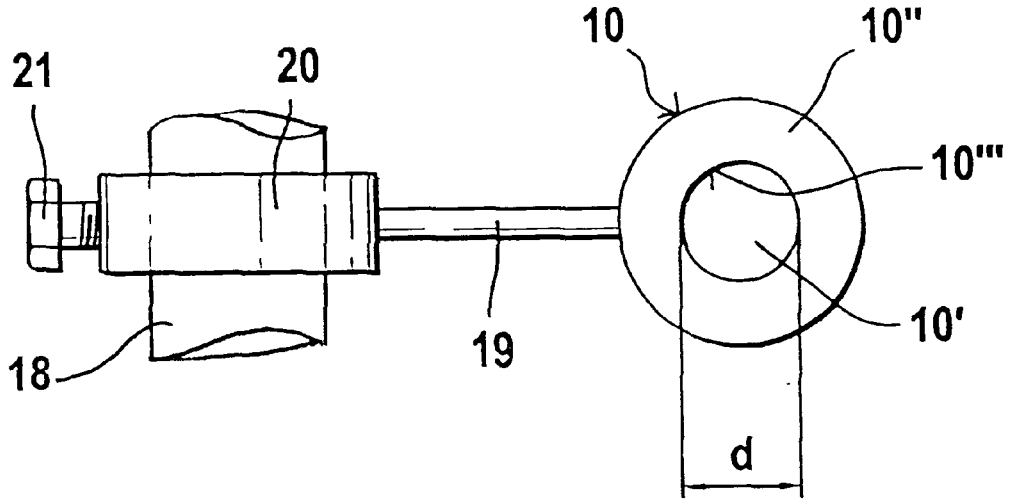
FIGS. 4*a* and 4*b* are schematic top plan views of a detail of FIG. 3.
Figure 4B:
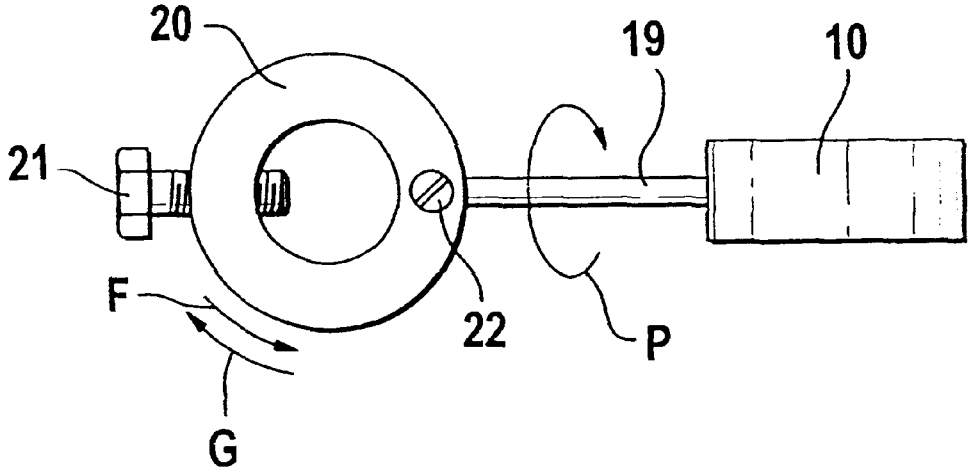

The sliver guides 10*a*–10*f* of FIG. 1 and the sliver guides 10*a*–10*d* of FIG. 2 are of identical construction. Such a sliver guide is generally designated at 10 in FIG. 4*a*. The sliver guide 10 is formed of an annular jacket 10" defining a throughgoing inner space 10' which may have a diameter d of, for example, 20–25 mm. The circular edges of the jacket 10" bounding the space 10' on both sides may be chamfered or rounded. The inner wall face 10'" of the jacket 10" is smooth for allowing the sliver to pass therethrough with low friction. The material of the sliver guide 10 is wear resistant and may be, for example, an aluminum alloy. The sliver guide 10 is mounted on a securing ring 20 by means of a holding rod 19. The position of the securing ring 20 on the holding bar 18 is, after a suitable adjustment in the direction F or G, immobilized by a setscrew 21. The angular position of the sliver guide 10 related to the securing ring 20 may also be changed by rotating the sliver guide 10, together with the holding bar 19 in the direction E, whereby different magnitudes and/or positions of the coiler cans with respect to the location of the sliver guide 10 may be taken into account. In this manner the extent of deflection of the sliver by the sliver guide 10 may be adjusted. The position of the holding bar 19 and thus the sliver guide 10 is immobilized with respect to the securing ring 20 by means of a screw 22. FIG. 4*b* shows an essentially horizontal position of the sliver guide 10 which is an expedient orientation in practice.

Figure 5A:
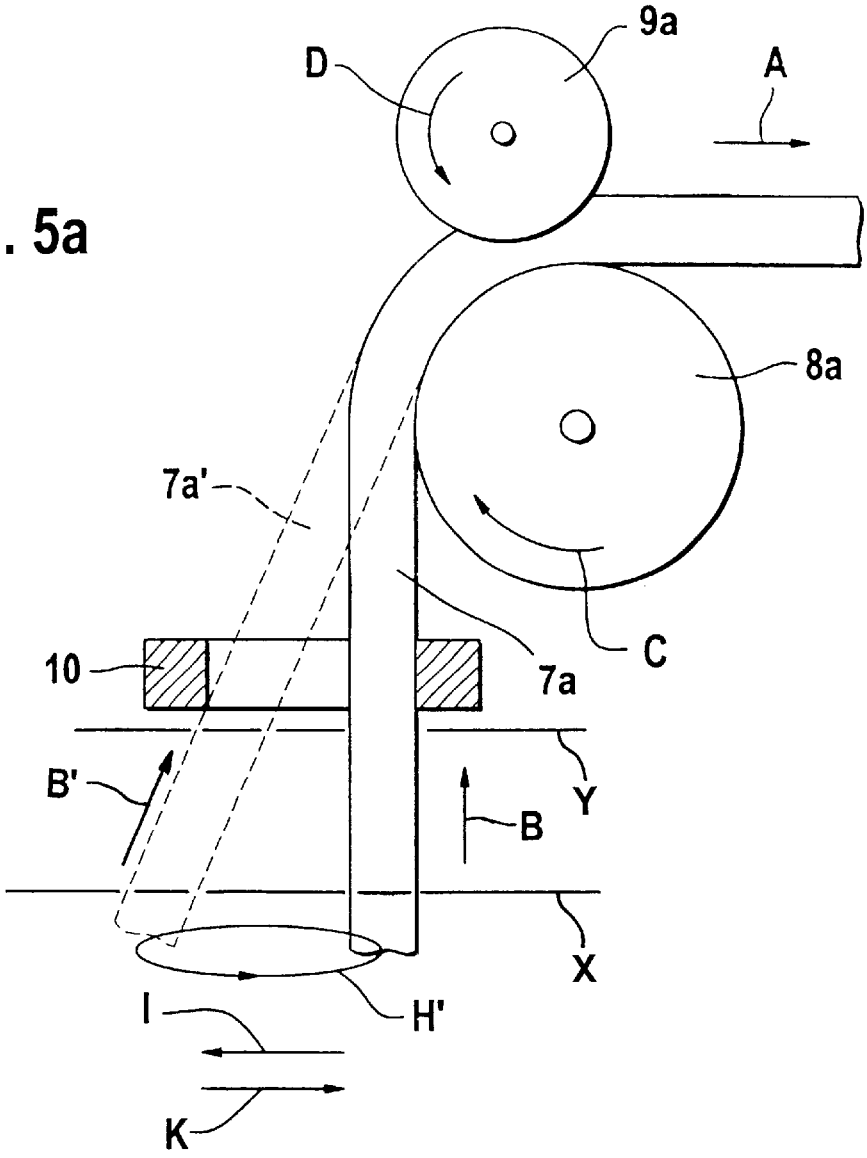
FIG. 5*a* is a schematic side elevational view illustrating the motion of the sliver before, during and after its passage through the inner space of an annular sliver guide.

The apparatus according to the invention can monitor whether all the slivers 7*a*–7*h* (thus, usually up to eight in number) which should enter the textile machine, particularly a draw frame, are in fact present. Further, it is not only recognized whether the slivers are present or absent but also whether they move or are at a standstill. In some cases it may occur that while a particular sliver is present, it has ruptured and thus does not enter the machine for further processing. The detection of each sliver occurs in the region of the creel 6, in the zone of the location of deflection, where the sliver is essentially vertically pulled from the respective coiler can and is brought by a respective sliver guiding and deflecting elements into a horizontal position. This is illustrated in FIG. 5*a*, for example, for the sliver 7*a*. Since the sliver 7*a* is deposited in loops in the coiler cans 5*a* and further, since the sliver 7*a* directly engage the supply roll (deflecting roll) 8*a*, that is, the sliver 7*a* is clamped between the supply roll 8*a* and the cooperating upper roll 9*a*, it moves along a track H'. A momentary position of the sliver is shown in phantom lines and is designated at 7*a*'. In that momentary position the upward advancing direction is designated at B'. Thus, during its upward motion the sliver balloons, and consequently, as viewed in side elevation, it reciprocates laterally as shown by arrows I and K. Describing the sliver motion in different terms, reference is made to two imaginary planes X and Y drawn in the space where the sliver 7*a* executes its continuous lateral displacement H'. Viewing the space portion between the two imaginary planes X and Y, it is seen that in that fixed space portion the sliver is unsupported and it continuously executes two motions: it advances upward parallel to its length dimension as designated at B, B' and it also moves transversely to the advancing direction B, B' as designated by the arrows I,K. Such a continuous transverse motion, considering a single point which does not move in space in the direction B, B', describes the closed curve H'. The envelope of the balloon described as the sliver 7 is advanced has a non-illustrated virtual longitudinal axis. In practice, the balloon has an irregular shape, that is, the path H' is circular only in an ideal case; it generally describes an oval. According to FIG. 5*b*, in the inner space 10' the running sliver moves essentially perpendicularly to the longitudinal advancing direction (which is perpendicular to the plane of FIG. 5*b*), that is, perpendicularly to the non-illustrated virtual axis of the balloon. The direction of the path H follows the direction of removal of the loops deposited in the coiler can 5.

The detection occurs by electro-optical assemblies composed of one or several transmitter/receiver and/or reflector combinations. These assemblies are expediently directly integrated in the sliver guide 10 (FIGS. 6 and 7) and form a detecting unit. Differently configured sliver guides, such as guiding organs shown in FIG. 2*b* may also be used. The number of transmitters and receivers and their arrangement inside such a unit depends, among others, from the utilized detection principle as well as from the shape of the sliver guide.

Figure 6:
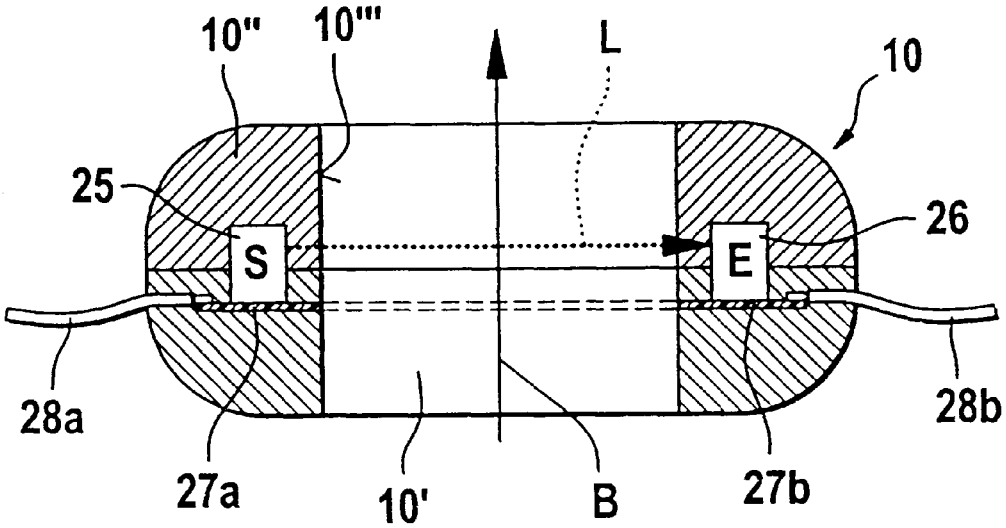
FIG. 6 is a schematic sectional view of a sliver guide including an integrated electrooptical transmitter and receiver.

According to the schematic sectional FIG. 6 a transmitter 25 (also designated at S) and a receiver 26 (also designated at E) face one another within the jacket 10" of the sliver guide 10. The sensor beam emitted by the transmitter 25 and directed toward the receiver 26 is designated at L. The inner wall 10'" is pervious to the sensor beam L in the region of the transmitter 25 and the receiver 26. The transmitter 25 and the receiver 26 contact a respective tab 27*a* and 27*b* to which respective coupling cables 28*a* and 28*b* are connected.

Figure 7:
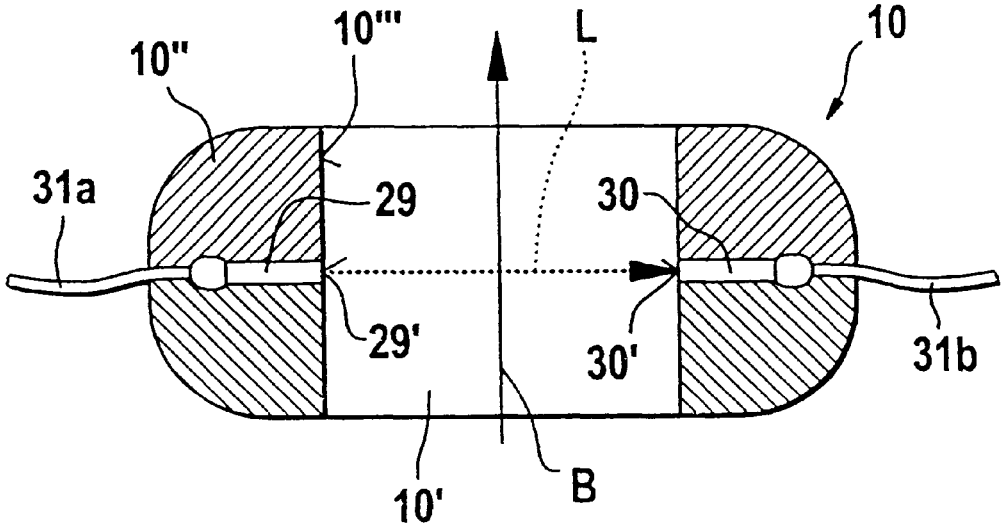
FIG. 7 is a schematic sectional view of a sliver guide including integrated optical wave guides.
Figure 12:
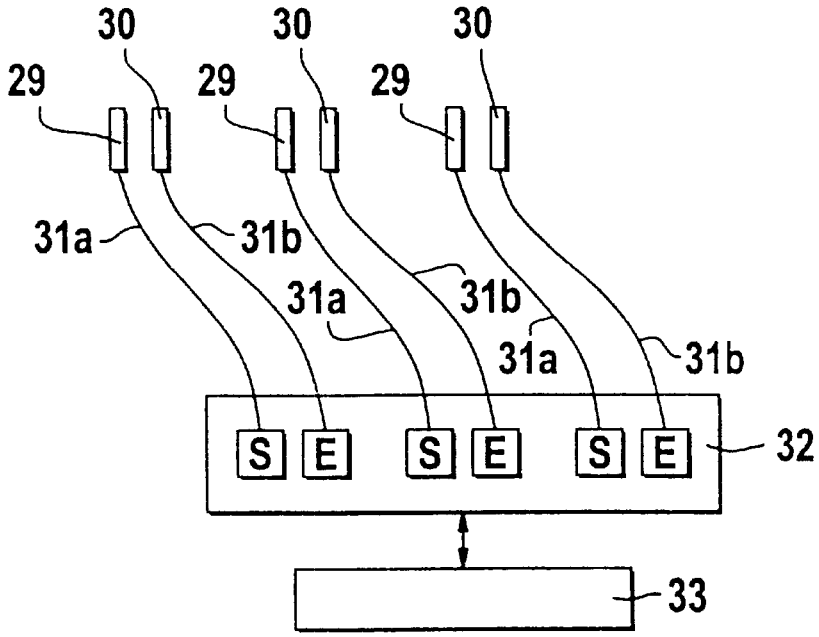
FIG. 12 is a schematic illustration of a configuration with light wave guides.

According to FIG. 7, in the jacket 10" a transmitter element 29 and a receiver element 30 are disposed whose exposed respective end faces 29' and 30' face one another. The end faces 29', 30', similarly to the transmitter 25 and the receiver 26 in the FIG. 6 arrangement, may be flush with and thus parts of, the inner surface 10'". The transmitter element 29 is connected by an optical wave guide 31*a* and the receiver element 30 is connected via an optical wave guide 31*b* to a central evaluating unit 32 as shown in FIG. 12.

In FIGS. 8*a*–8*f* examples of transmitter/receiver/reflector arrangements are shown.

One-way, reflection or scanning modes may find application as operational principles. An undesired scattering of the emitted and received sensor beam (light beam) is, if required, filtered out by screens or lenses before such scattered light reaches the electrooptical transmitter or receiver elements S or E.

Figure 9:
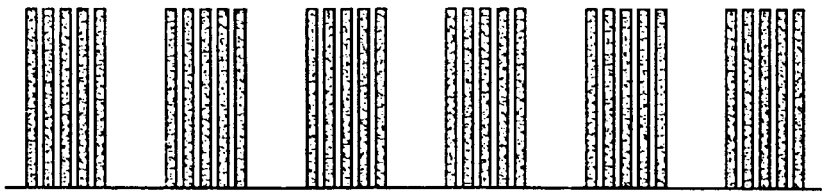
FIG. 9 is a graph illustrating modulated control pulses of transmitter diodes.

To substantially eliminate external interferences, such as external light, the transmitter and receiving elements are driven with modulated light as shown in an example in FIG. 9. This means that the transmitter diodes emit light according to a predetermined pulse pattern and the receivers respond only to such light pattern.

Figure 10:
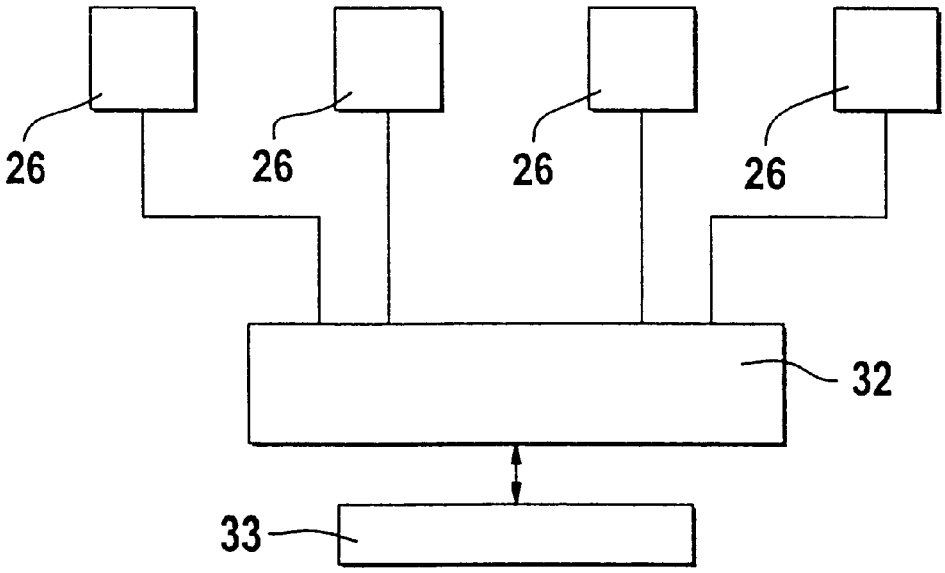
FIG. 10 is a block diagram of detecting units connected to a central evaluating unit of the control system of the fiber processing machine.

A particularly economical evaluation of the signals emitted by the receivers E may be achieved if not all receivers E have their own evaluating units but are coupled to a central evaluating unit 32. Such a unit is preferably provided with a programmable control device (such as a microprocessor) and is additionally connected with the usual draw frame control system 33, as shown FIG. 10. By virtue of such an arrangement, for the evaluation, particularly for determining whether a sliver moves or is stationary, important information, such as production rate may be taken into consideration. Advantageously, the evaluating unit 32 constitutes a structural group which may be integrated into the usual machine control system. In case only a single determination is required, namely, whether or not a sliver is present, the transmitter/receiver/reflector combination shown in FIG. 8*e* presents a particularly advantageous arrangement. In case the receiver E is dark, a sliver 7 is present.

Figure 5B:
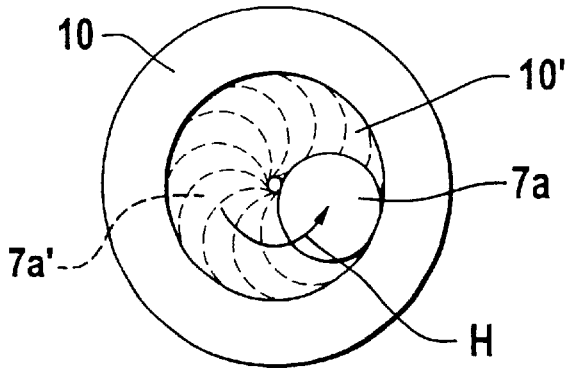
FIG. 5*b* is a top plan view illustrating the motion of the sliver in the sliver guide shown in FIG. 5*a*.
Figure 8A:
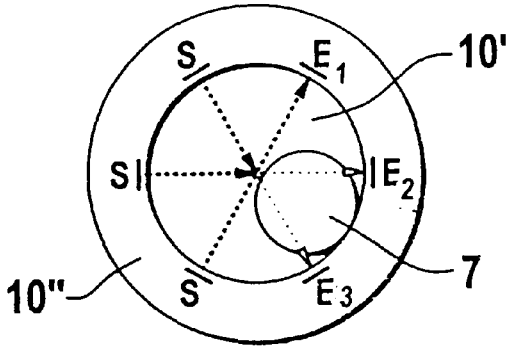
FIGS. 8*a*–8*f* are schematic top plan views of various embodiments of the apparatus according to the invention.
Figure 8B:
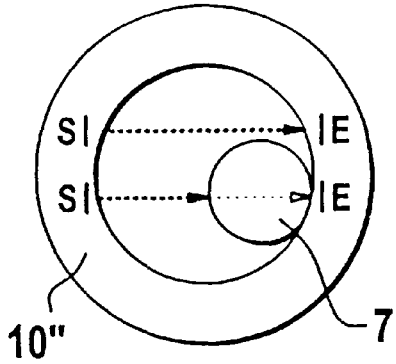
Figure 8C:
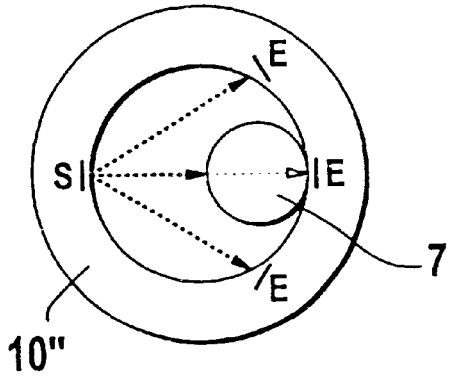
Figure 8D:
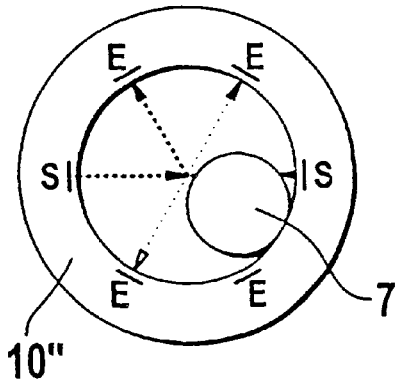
Figure 8E:
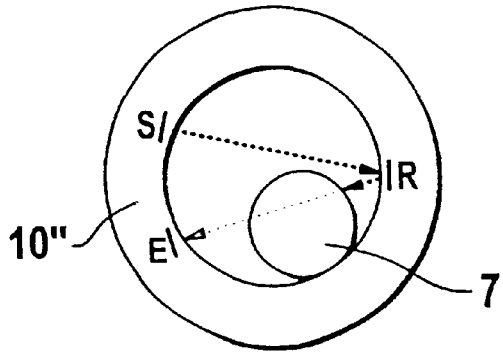
Figure 8F:
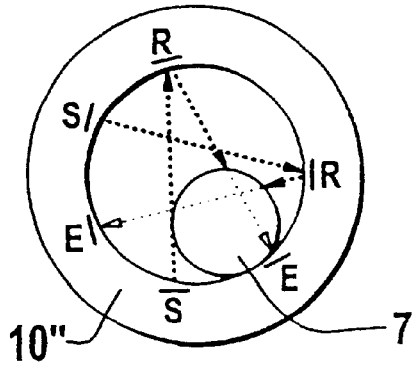

To detect whether a sliver 7 advances or is stationary, an arrangement with several receivers is expedient, for example, as shown in FIG. 8*a*. Since the sliver 7 has, during operation, a radial motion component within the sliver guide 10, the desired information may be obtained from the receiver signals by appropriate computer-controlled evaluation. When several receivers are used, the sliver, as a result of its radial motion component (radial displacements) within the sliver guide 10, alternatingly renders the receivers dark or light. A dark receiver E means that a sliver 7 is present. A switching between light and dark of a receiver or receivers E means an advancing sliver, since a radial motion component (displacement in the direction I,K in FIG. 5*a*) is present only if the sliver advances, that is, it is pulled through the sliver guide 10. Ideally, during operation the sliver 7 runs on a circular path H within the sliver guide 10, as shown in FIG. 5*b*.

Figure 11:
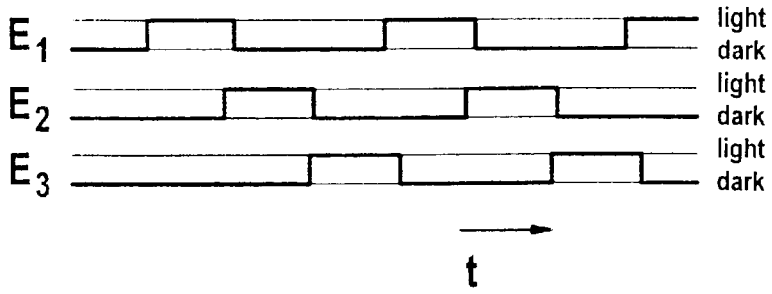
FIG. 11 is a diagram illustrating signals at the receivers as a sliver rotates within the sliver guide (FIG. 5*b*) and at a transmitter/receiver arrangement according to FIG. 8*a*.

In the arrangement according to FIG. 8*a* the three receivers $E_1$, $E_2$ and $E_3$ are light and dark according to a predetermined cyclic light pattern as illustrated in FIG. 11. The course of these signals depends substantially also from the output speed of the machine, that is, from the rotating speed of the sliver 7 within the sliver guide 10. Thus:

1. A sliver 7 is present if at least one receiver is dark;
2. A sliver 7 is present and in motion if within a certain time window the three receivers $E_1$, $E_2$ and $E_3$ are alternatingly light and dark.
3. No sliver 7 is present if all the receivers are light and no light-dark alternation occurs.

Since the velocity with which the sliver 7 moves inside the sliver guide 10 also depends from the machine output speed, this value may be expediently used to significantly improve the evaluating results. Further available machine-specific information may be utilized for the evaluation when required.

By communicating between the machine control system 33 and the evaluating unit 32, plausibility tests or other monitoring functions may be performed. Thus, for example, based on the known signal pattern in the receivers E, it may be determined whether or not the slivers run in a satisfactory manner in the creel 6.

According to a further advantageous embodiment illustrated in FIG. 12, at least the electrooptical receivers E are not directly integrated in the sliver guide 10 but are positioned on the evaluating unit 32 as shown in FIG. 12. The light rays emanating from the transmitters S are advanced by optical wave guides 31*a*, 31*b* (for example, fiberglass cable) to the receivers E disposed on the evaluating unit 32. If such an embodiment is also chosen for the transmitters 29 (FIG. 7) then no electronic devices, terminal tabs, cables or the like need to be placed in the sliver guide 10.

A self-learning system may by obtained if a microprocessor is integrated in the evaluating unit 32 or such a microprocessor is connected to the evaluating unit 32 as part of the control operation. The sliver moving within the sliver guide generates in the receivers a certain signal pattern (as shown, for example, in FIG. 11). Such a pattern may be detected at the beginning of the production process as well as at determined timely intervals or as a function of certain procedures and subsequently utilized for the production in progress as a satisfactory comparison pattern.

Figure 13:
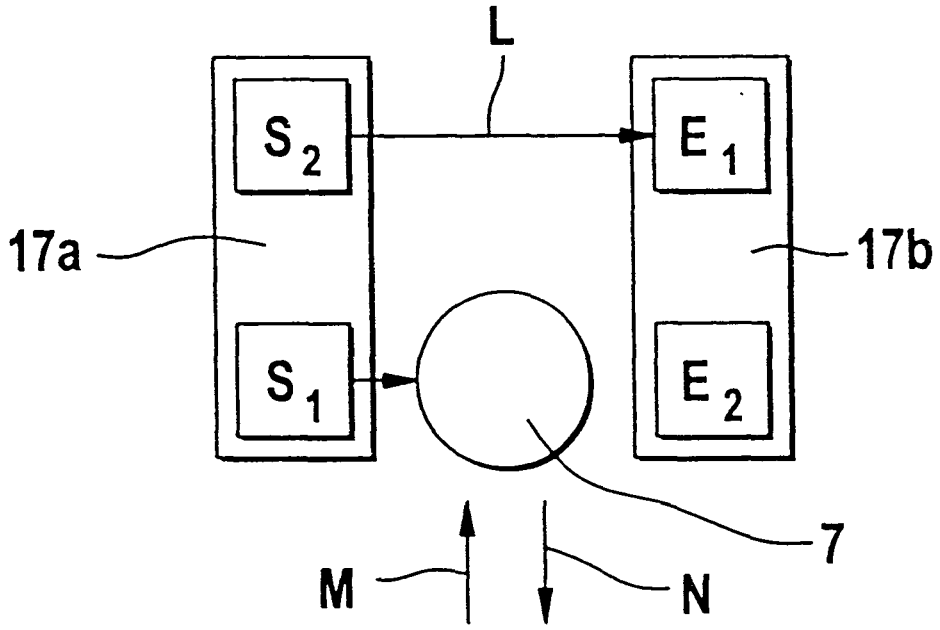
FIG. 13 is a schematic front elevation view of a further embodiment of the invention where the sliver is guided between two spaced sliver guide elements.

According to the embodiment illustrated in FIG. 13, the sliver sensor units are associated with any two adjoining sliver guiding components 17*a*, 17*b* between which a sliver passes. Thus, as illustrated, the guide component 17*a* accommodates two spaced, superposed transmitters S1 and S2, while the guide component 17*b* accommodates two spaced, superposed receivers E1 and E2 cooperating with the respective transmitters S1 and S2. During operation, as the sliver 7 runs into the draw unit 2, it also moves essentially in a vertical direction, as indicated by the arrows M, N.

It will be understood that the above description of the present invention is susceptible to various modifications, changes and adaptations, and the same are intended to be comprehended within the meaning and range of equivalents of the appended claims.

What is claimed is:

1. A fiber processing machine comprising (a) first means f or forwarding a sliver through a space in an advancing direction; said sliver having a length portion extending through and from a first imaginary plane traversing said space to and through a second imaginary plane traversing said space; said length portion being unsupported between said first and second imaginary planes;

(b) second means for continuously displacing the sliver in said space between said first and second imaginary planes transversely to said advancing direction while the sliver is forwarded in said advancing direction, whereby said length portion continuously changes position transversely to itself between said first and second imaginary planes; and (c) an apparatus for detecting a presence, absence, motion or standstill of a sliver, including (1) a transmitter emitting a sensor beam passing through said space transversely to said advancing direction for being intermittently interrupted by the sliver during displacement thereof transversely to said advancing direction; and (2) a receiver positioned in a path of the sensor beam for receiving a light or a dark signal dependent whether or not the sensor beam is interrupted by the sliver during displacement thereof transversely to said advancing direction.

2. The fiber processing machine as defined in claim 1, further comprising a mirror for deflecting said sensor beam from said transmitter toward said receiver.

3. The fiber processing machine as defined in claim 1, further comprising a microcomputer control and regulating device to which said transmitter and said receiver are connected.

4. The fiber processing machine as defined in claim 1, further comprising an electronic evaluating device to which said transmitter and said receiver are connected for evaluating signals produced by said receiver.

5. The fiber processing machine as defined in claim 1, wherein said advancing direction of the sliver in said space is upwardly oriented and said sensor beam has a substantially horizontal course.

6. The fiber processing machine as defined in claim 1, further comprising a first light wave guide leading from said transmitter to a location in said space for emitting light through said space and a second light wave guide leading from a location in said space to said receiver for conducting light to said receiver.

7. The fiber processing machine as defined in claim 1, further comprising means for evaluating signals produced by said receiver while including production parameters of the fiber processing machine.

8. The fiber processing machine as defined in claim 1, further comprising a sliver guide having two components between which the sliver passes; said space being defined and flanked by said two components.

9. The fiber processing machine as defined in claim 1, there being provided a plurality of receivers which are cyclically light and dark as the sliver passes through said space; further comprising an evaluating device connected to said receivers for determining a signal pattern from dark and light signals produced by said receivers.

10. The fiber processing machine as defined in claim 9, further comprising means for comparing the signal pattern with previously stored signal patterns.

11. The fiber processing machine as defined in claim 1, further comprising (d) a machine control system for operating components of the fiber processing machine;

(e) evaluating means connected to said receiver for receiving signals produced by said receiver; and (f) means for applying signals of said evaluating means to said machine control system controlling operation of said fiber processing machine as a function of signals from said evaluating means.

12. The fiber processing machine as defined in claim 11, said evaluating means comprises means for applying to said machine control system first signals representing a presence or absence of sliver and separate, second signals representing motion or standstill of sliver.

13. The fiber processing machine as defined in claim 11, further comprising means for braking components of the fiber processing machine when signals representing one of an absence and standstill of the sliver.

14. The fiber processing machine as defined in claim 1, further comprising a sliver guide defining an inner space; said inner space being said space through which the sliver passes.

15. The fiber processing machine as defined in claim 14, wherein said inner space has a circular cross section as viewed along a plane transverse to said advancing direction.

16. The fiber processing machine as defined in claim 14, wherein said sliver guide includes a jacket defining and surrounding said inner space; and further wherein said transmitter and said receiver are disposed in said jacket.

17. The fiber processing machine as defined in claim 14, wherein said fiber processing machine is a draw frame including a creel; said sliver guide is mounted on said creel.

18. The fiber processing machine as defined in claim 17, further comprising a coiler can positioned under said creel and a supply roll assembly for pulling sliver from said coiler can; said sliver guide is positioned between said supply roll assembly and said coiler can.

19. A fiber processing machine comprising (a) first means for forwarding a plurality of slivers in an advancing direction;

(b) a plurality of sliver guides each surrounding a space through which a separate said sliver passes;

(c) second means for continuously displacing the slivers in respective said spaces transversely to said advancing direction while the slivers are forwarded in said advancing direction, whereby the slivers continuously change position within said respective spaces transversely to themselves; and (d) a separate apparatus associated with each said sliver guide for detecting a presence, absence, motion or standstill of the respective slivers; each apparatus including (1) a transmitter emitting a sensor beam passing through said space of a respective said sliver guide transversely to said advancing direction for being intermittently and repeatedly interrupted by the sliver during displacement thereof transversely to said advancing direction; and (2) a receiver positioned in a path of the sensor beam for receiving a light or a dark signal dependent whether or not the sensor beam is interrupted by the sliver during continuous displacement thereof transversely to said advancing direction.

* * * * *